US010852012B2

(12) United States Patent
Takeuchi et al.

(10) Patent No.: US 10,852,012 B2
(45) Date of Patent: Dec. 1, 2020

(54) OUTDOOR UNIT OF AIR-CONDITIONING APPARATUS

(71) Applicant: Mitsubishi Electric Corporation, Tokyo (JP)

(72) Inventors: Yuto Takeuchi, Tokyo (JP); Kazuho Ito, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 16/334,058

(22) PCT Filed: Dec. 16, 2016

(86) PCT No.: PCT/JP2016/087592
§ 371 (c)(1),
(2) Date: Mar. 18, 2019

(87) PCT Pub. No.: WO2018/109932
PCT Pub. Date: Jun. 21, 2018

(65) Prior Publication Data

US 2019/0271477 A1 Sep. 5, 2019

(51) Int. Cl.
*F24F 1/22* (2011.01)
*F24F 1/56* (2011.01)
*F24F 13/20* (2006.01)

(52) U.S. Cl.
CPC ..... *F24F 1/22* (2013.01); *F24F 1/56* (2013.01); *F24F 2013/207* (2013.01)

(58) Field of Classification Search
CPC ..... F24F 1/22; F24F 1/56; F24F 2013/207; F24F 1/20; H01R 9/24; H01R 9/00; H01R 9/2458; H01R 9/26; H01R 9/28; H01R 11/00; H01R 12/515
See application file for complete search history.

(56) References Cited

U.S. PATENT DOCUMENTS 6,821,152 B2 * 11/2004 Van Dyke ..... H01R 25/006 361/629
2011/0232860 A1 * 9/2011 Lackie ..... F24F 3/0442 165/59

FOREIGN PATENT DOCUMENTS

JP H07-280295 A 10/1995
JP 2002-022211 A 1/2002
JP 2003-115335 A 4/2003

OTHER PUBLICATIONS

Office Action dated Jun. 1, 2020 issued in corresponding CN patent application No. 201680091509.9 (and English translation).

* cited by examiner

*Primary Examiner* — Jayprakash N Gandhi
*Assistant Examiner* — Hung Q Dang
(74) *Attorney, Agent, or Firm* — Posz Law Group, PLC

(57) ABSTRACT

An outdoor unit of an air-conditioning apparatus includes a casing forming an outer shell, a terminal block disposed in the casing, a terminal block support element configured to support the terminal block, and an earth grounding plate sandwiched between the terminal block and the terminal block support element. An engaging portion to be engaged with the terminal block support element is provided in the earth grounding plate. A fixing element is provided to fasten the terminal block and the earth grounding plate engaged with the terminal block support element by the engaging portion together to the terminal block support element.

3 Claims, 9 Drawing Sheets

OUTDOOR UNIT OF AIR-CONDITIONING APPARATUS

CROSS REFERENCE TO RELATED APPLICATION

This application is a U.S. national stage application of PCT/JP2016/087592 filed on Dec. 16, 2016, the contents of which are incorporated herein by reference.

TECHNICAL FIELD

The present invention relates to an outdoor unit of an air-conditioning apparatus provided with a sheet metal part for ground connection on a terminal block.

BACKGROUND ART

There has been conventionally known an outdoor unit of an air-conditioning apparatus including a terminal block for connecting a wiring to a terminal of an electric component unit stored in a casing, and a terminal block support element made of a synthetic resin and configured to support the terminal block.

For example, Patent Literature 1 discloses a power line fixing device that fixes power lines of a power source and is provided in an electric component box made of a resin and used for the air-conditioning apparatus. This power line fixing device has a configuration in which a plurality of terminals as terminal blocks are arranged in parallel to one another on a surface of the electric component box made of a resin as a terminal block support element, and each of the plurality of terminals is individually screw-joined to the surface of the electric component box made of a resin. A reinforcement sheet metal is attached to a rear surface of the electric component box made of a resin to connect an electricity leakage shutdown device.

CITATION LIST

Patent Literature

Patent Literature 1: Japanese Unexamined Patent Application Publication No. Hei 7-280295

SUMMARY OF INVENTION

Technical Problem

In the power line fixing device disclosed in Patent Literature 1, a reinforcing plate and a plurality of terminal blocks are individually screw-joined to the electric component box made of a resin, resulting in an increase in the number of assembly processes. Therefore, in the power line fixing device, man hours are required for the assembling work, leading to poor workability. In this power line fixing device, a plurality of screw elements are required, resulting in an increase in number of elements, and screw holes into which the screw elements are screwed are required to be formed, resulting in an increase in cost. Furthermore, since the power line fixing device is provided with no unit for engaging and temporarily fixing the reinforcing plate, it is necessary to fix the reinforcing plate to the electric component box made of a resin with screw elements while holding the reinforcing plate by hands to prevent it from being moved, resulting in poor workability.

The present invention has been made to solve the problems described above, and an object thereof is to provide an outdoor unit of an air-conditioning apparatus capable of improving the workability of an assembly work for attaching a terminal block and an earth grounding plate to a terminal block support element.

Solution to Problem

An outdoor unit of an air-conditioning apparatus, comprising: a casing that forms an outer shell; a terminal block disposed in the casing; a terminal block support element configured to support the terminal block; and an earth grounding plate sandwiched between the terminal block and the terminal block support element, wherein an engaging portion to be engaged with the terminal block support element is provided in the earth grounding plate, and a fixing element is provided to fasten the terminal block and the earth grounding plate engaged with the terminal block support element by the engaging portion together to the terminal block support element.

Advantageous Effects of Invention

According to the outdoor unit of the air-conditioning apparatus of the embodiment of the present invention, the engaging portion to be engaged with the terminal block support element is formed in the earth grounding plate, and the fixing element is provided to fasten the terminal block and the earth grounding plate engaged with the terminal block support element together to the terminal block support element. Therefore, in the outdoor unit, during the assembling work for attaching the terminal block and the earth grounding plate to the terminal block support element, since the earth grounding plate is engaged with and temporarily fixed to the terminal block support element by the engaging portion so that the earth grounding plate is stably held, the terminal block and the earth grounding plate can be fastened together to the terminal block support element by a common fixing element, whereby man hours required for the assembling work can be reduced and the workability can be improved.

DESCRIPTION OF EMBODIMENTS

Figure 1:
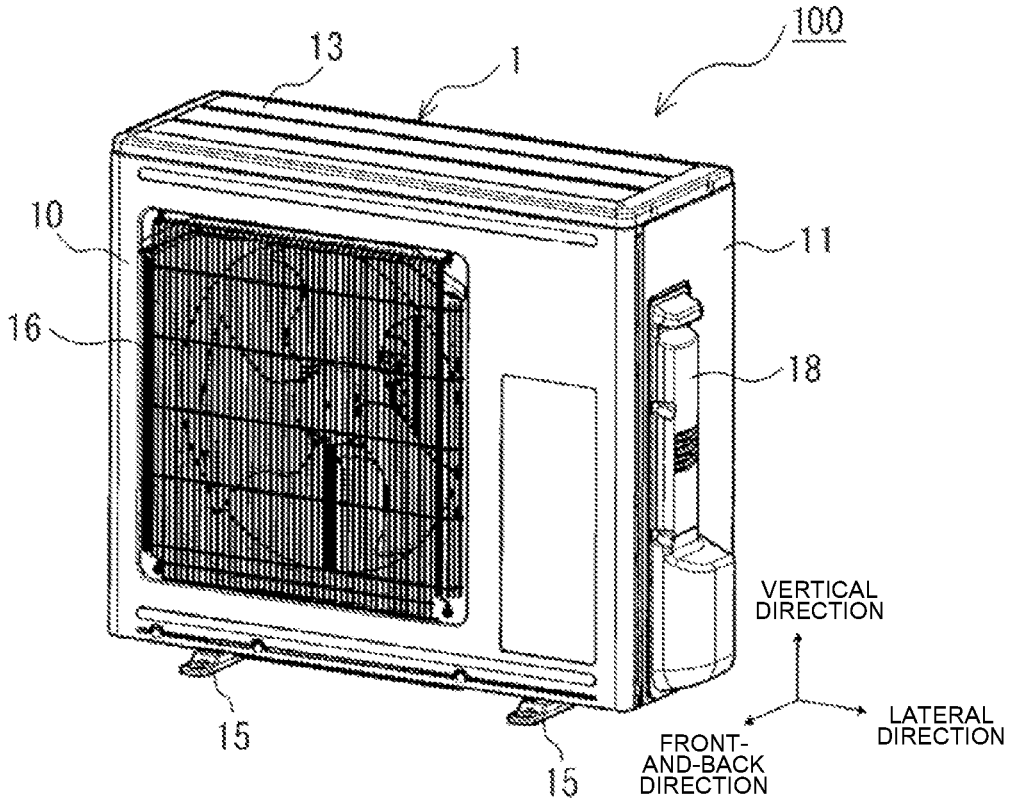
FIG. 1 is a perspective view illustrating an outdoor unit of an air-conditioning apparatus according to an embodiment of the present invention.

Hereinafter, embodiments of the present invention will be described with reference to the drawings. In the drawings, identical or corresponding portions are denoted by the same reference numerals, and descriptions thereon will be appropriately omitted or simplified. Variations may be made as appropriate to the shapes, sizes, relative positions, and other specific details of individual features as illustrated in the drawings within the scope of the present invention.

Embodiment

Figure 2:
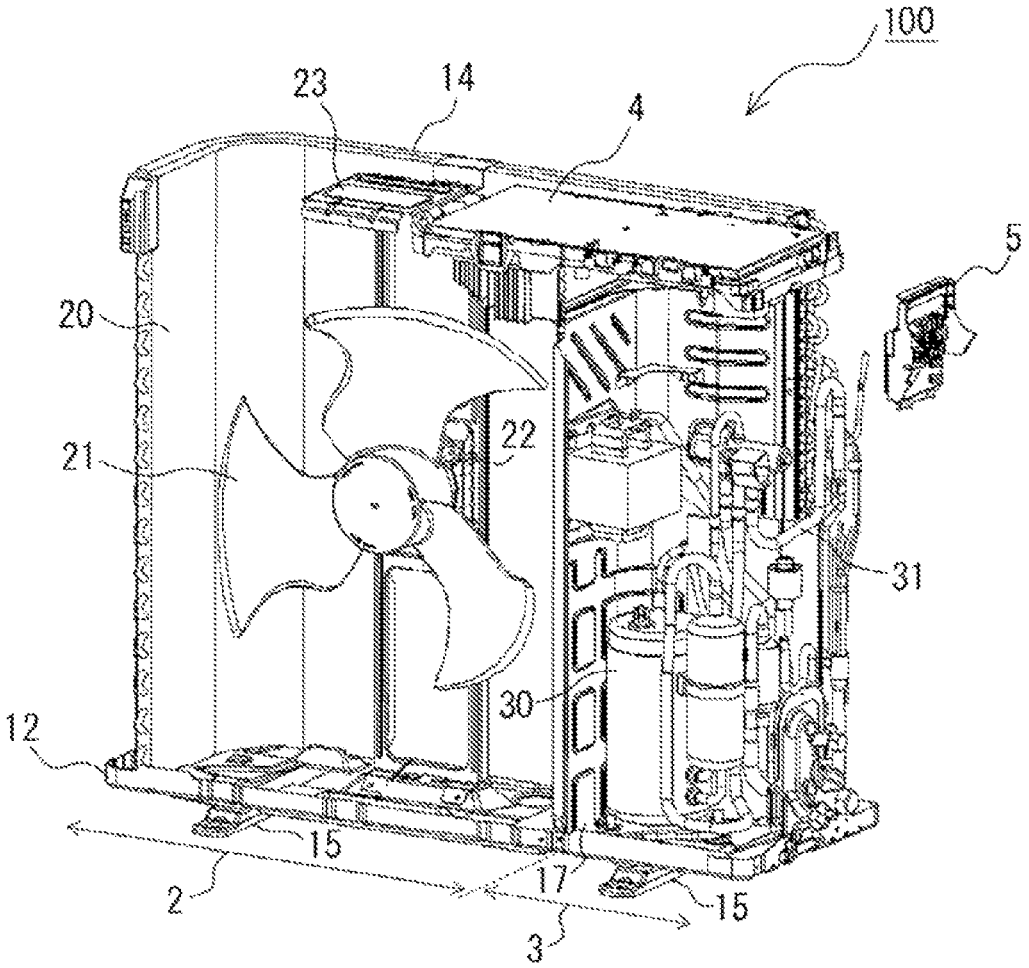
FIG. 2 is a perspective view illustrating an internal configuration of the outdoor unit of the air-conditioning apparatus according to the embodiment of the present invention.

FIG. 1 is a perspective view illustrating an outdoor unit of an air-conditioning apparatus according to an embodiment of the present invention. FIG. 2 is a perspective view illustrating an internal configuration of the outdoor unit of the air-conditioning apparatus according to the embodiment of the present invention. Note that front-and-back, lateral, and vertical directions described below are defined by directions illustrated in FIG. 1.

An outdoor unit 100 of an air-conditioning apparatus according to the embodiment includes a casing 1 that forms an outer shell of the outdoor unit 100, as illustrated in FIG. 1. By way of example, the casing 1 includes a front-and-side panel 10, a right panel 11, a bottom panel 12, a top panel 13, and a rear panel 14. The front-and-side panel 10 forms a front face and a left side face of the casing 1, and has, for example, an L-shape in plan view. The front-and-side panel 10 of the casing 1 has a circular-shaped air outlet formed therein, and a fan guard 16 is attached to cover the air outlet. The outdoor unit 100 has a structure in which leg portions 15 are attached to a lower surface of the bottom panel 12 to be fixedly secured to an installation place.

As illustrated in FIG. 2, the casing 1 is defined by a separator 17 to be a fan compartment 2 in which heat is exchanged by a heat exchanger 20 and a propeller fan 21 and a machine compartment 3 in which refrigerant is compressed by a compressor 30.

In the fan compartment 2, the heat exchanger 20, the propeller fan 21, a motor 22, and a motor mount 23 are disposed. The motor mount 23 is an element that holds the motor 22 to which the propeller fan 21 is attached. The motor mount 23 is disposed in front of the heat exchanger 20. The outdoor unit 100 is configured so that, when the propeller fan 21 rotates, air that has passed through the heat exchanger 20 flows into the outdoor unit 100, then passes through the propeller fan 21, and is discharged to the front of the outdoor unit 100. Thus, the outdoor unit 100 is configured so that, for example, during a cooling operation, the refrigerant in the heat exchanger 20 is cooled by air, and the air passing through the heat exchanger 20 is superheated by exchanging heat with the refrigerant.

In the machine compartment 3, the compressor 30, a refrigerant pipe 31, an electric component unit 4, and a power supply unit 5 are disposed. The compressor 30 is mounted on a top surface of the bottom panel 12. The compressor 30 compresses the refrigerant supplied from an indoor unit. The refrigerant compressed by the compressor 30 is supplied to the heat exchanger 20 through the refrigerant pipe 31. The electric component unit 4 and the power supply unit 5 are disposed above the compressor 30 and the refrigerant pipe 31.

Figure 3:
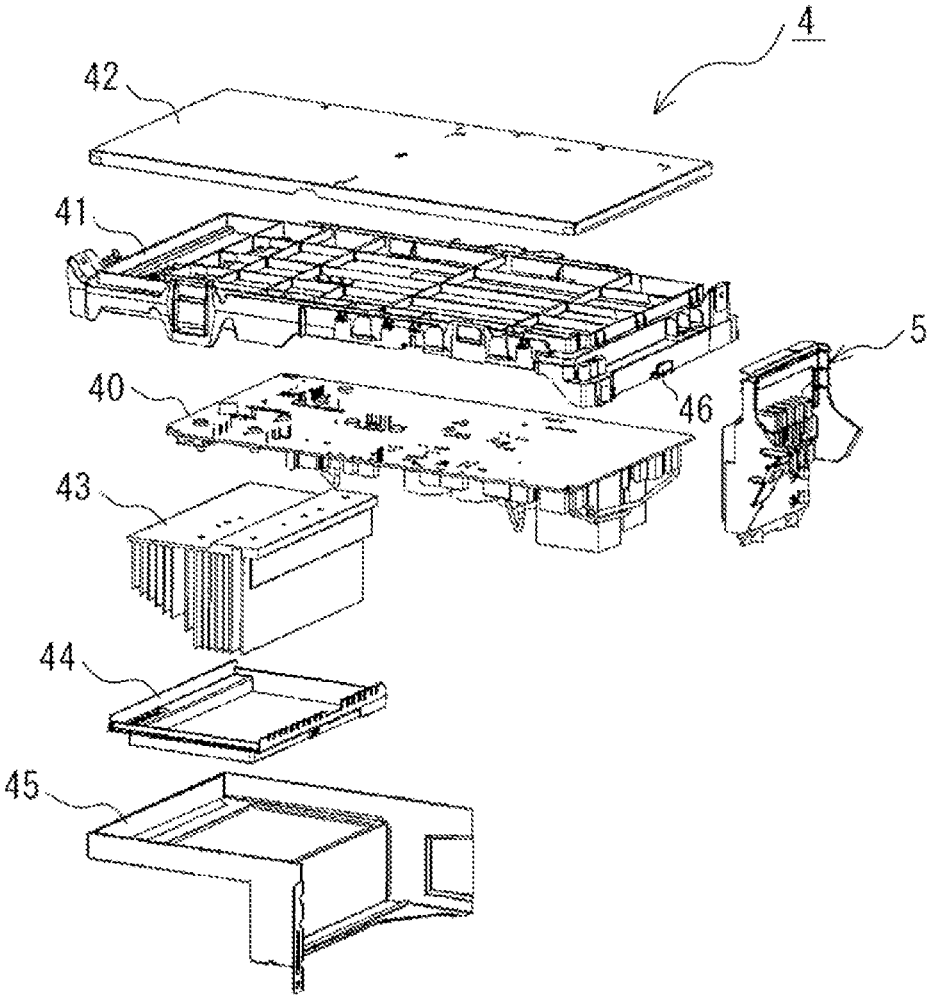
FIG. 3 is an exploded perspective view illustrating a state in which an electric component unit of the outdoor unit of the air-conditioning apparatus according to the embodiment of the present invention.
Figure 4:
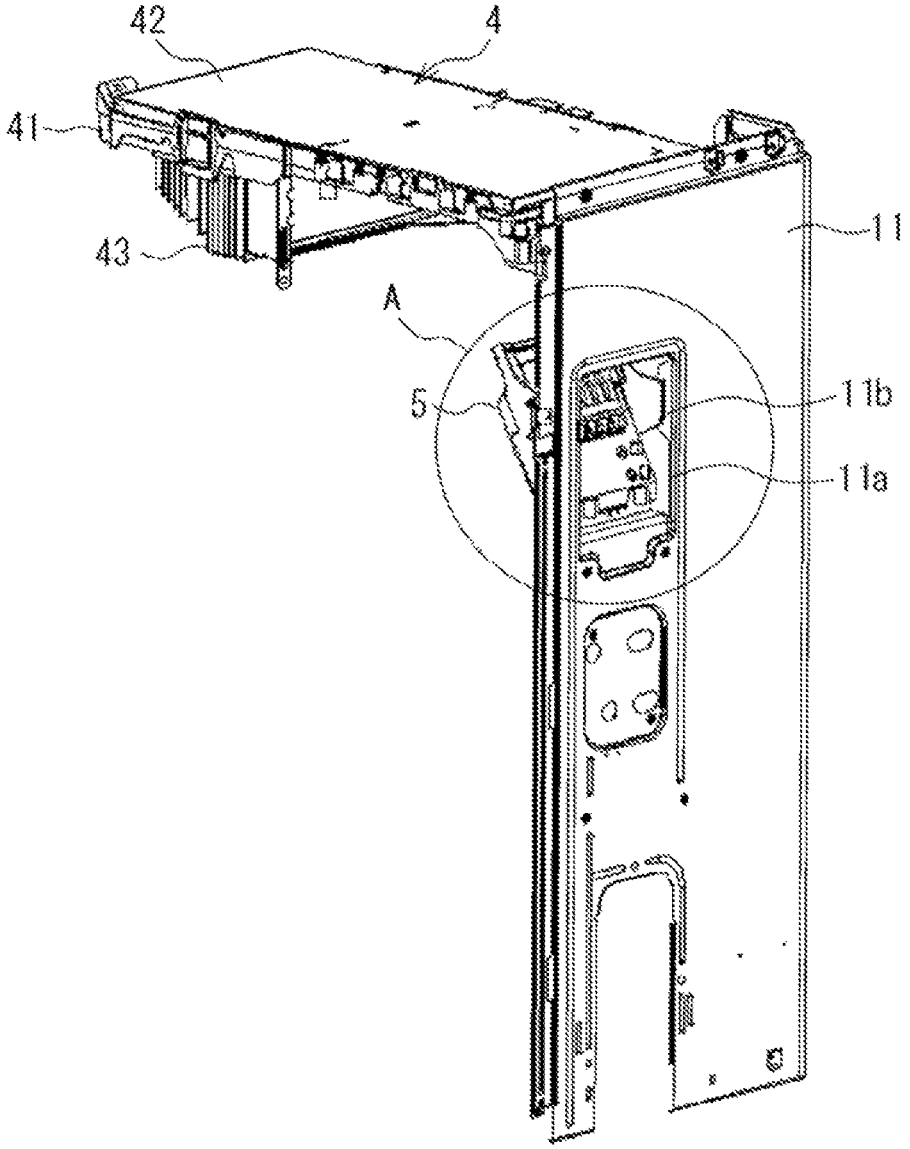
FIG. 4 is a partially enlarged perspective view illustrating the electric component unit of the outdoor unit of the air-conditioning apparatus according to the embodiment of the present invention and a state in which a power supply unit is attached to a right panel.
Figure 5:
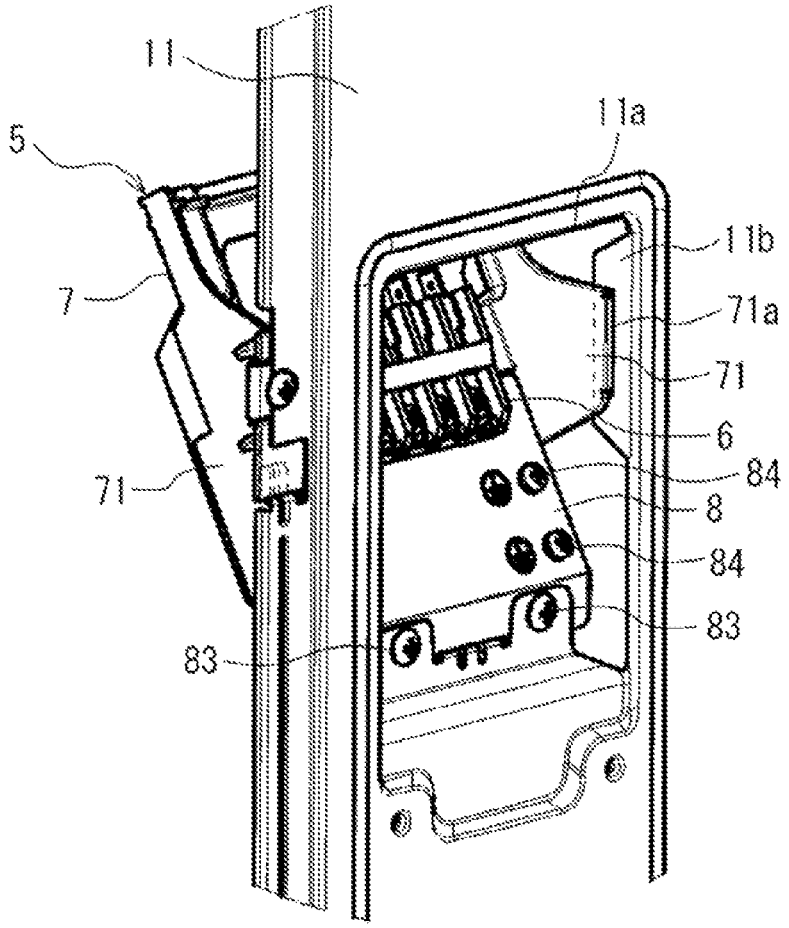
FIG. 5 is an enlarged view of a portion A illustrated in FIG. 4.

FIG. 3 is an exploded perspective view illustrating a state in which the electric component unit of the outdoor unit of the air-conditioning apparatus according to the embodiment of the present invention. FIG. 4 is a partially enlarged perspective view illustrating the electric component unit of the outdoor unit of the air-conditioning apparatus according to the embodiment of the present invention and a state in which the power supply unit is attached to the right panel. FIG. 5 is an enlarged view of a portion A illustrated in FIG. 4. As illustrated in FIG. 3, the electric component unit 4 includes a control circuit substrate 40, a substrate fixing frame 41 made of a synthetic resin and fixes the control circuit substrate 40, and a substrate protective sheet metal 42 attached to the top surface of the substrate fixing frame 41 and protects the control circuit substrate 40. The electric component unit 4 supplies power to each component. A heat sink 43 that assists the exhaust heat is assembled to the bottom surface of the control circuit substrate 40. The heat sink 43 is fixed by a heat sink fixing sheet metal 45 attached to the substrate fixing frame 41 through an insulating protective element 44 made of a synthetic resin.

As illustrated in FIG. 4 and FIG. 5, the power supply unit 5 is attached to attaching portions 11*b* in a state of being inclined toward the inside of the casing 1, the attaching portions 11*b* protruding toward the inside of the casing 1 from an opening edge of an opening port 11*a* formed in the right panel 11. The power supply unit 5 is exposed to the outside through the opening port 11*a* formed in the right panel 11. In the normal state, as illustrated in FIG. 1, the power supply unit 5 is covered by a protective cover 18 attached to the outer surface of the right panel 11, thereby to prevent dust or water from entering the opening port 11*a*. Note that a terminal block support element 7, an earth grounding plate 8, a flange 71, a claw portion 71*a*, a screw element 83, and a ground screw 84 as illustrated in FIG. 5 will be described later.

Figure 6:
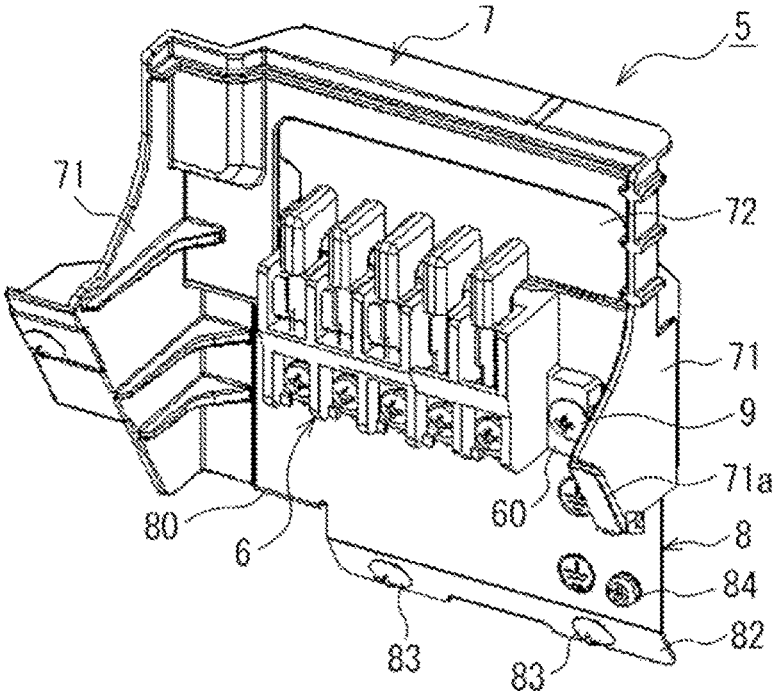
FIG. 6 is a perspective view illustrating the power supply unit of the outdoor unit of the air-conditioning apparatus according to the embodiment of the present invention when viewed from the front.
Figure 7:
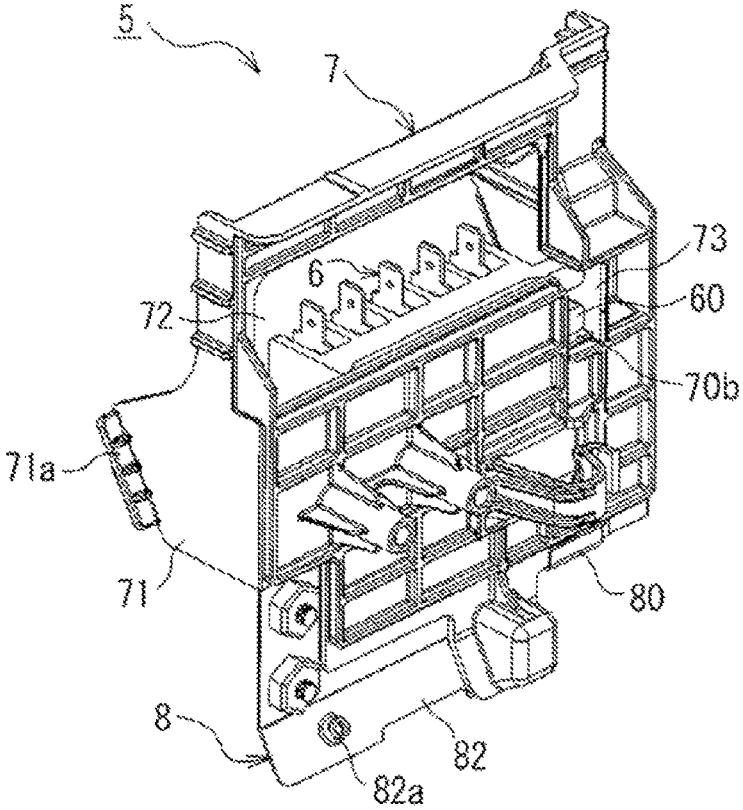
FIG. 7 is a perspective view illustrating the power supply unit of the outdoor unit of the air-conditioning apparatus according to the embodiment of the present invention when viewed from the rear.
Figure 8:
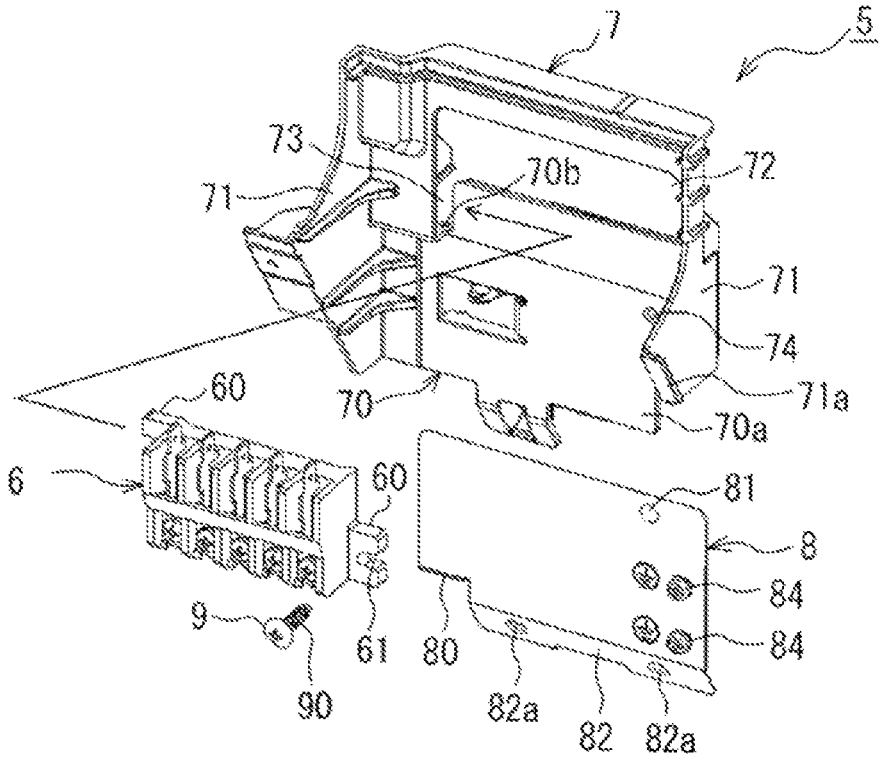
FIG. 8 is an exploded perspective view illustrating a state in which the power supply unit of the air-conditioning apparatus according to the embodiment of the present invention.
Figure 9:
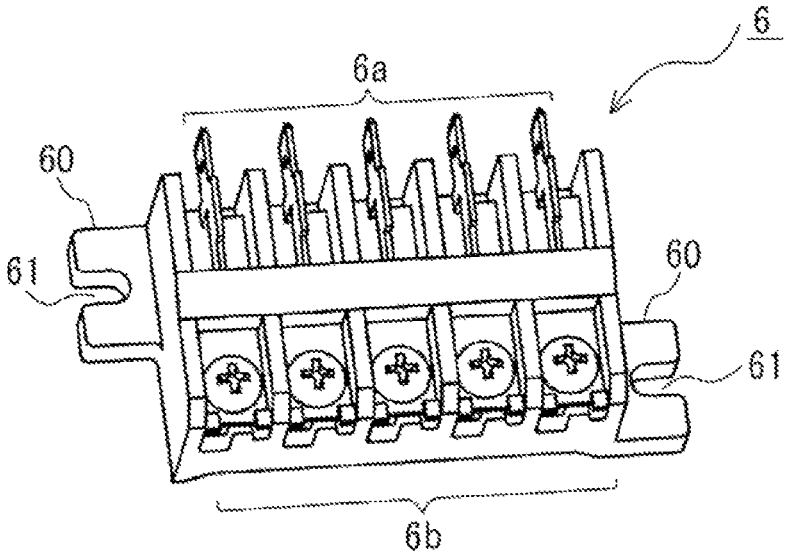
FIG. 9 is a perspective view illustrating a terminal block of the outdoor unit of the air-conditioning apparatus according to the embodiment of the present invention.
Figure 10:
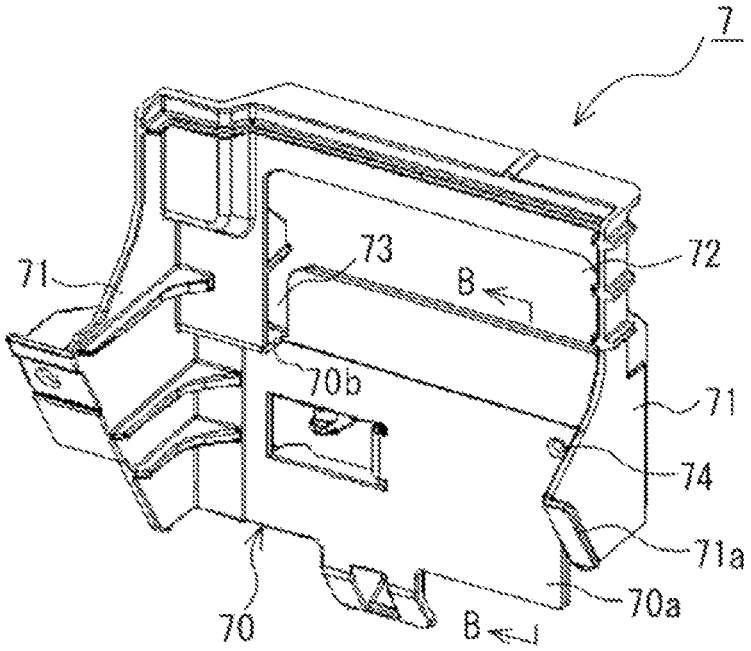
FIG. 10 is a perspective view illustrating a terminal block support element of the outdoor unit of the air-conditioning apparatus according to the embodiment of the present invention.
Figure 11:
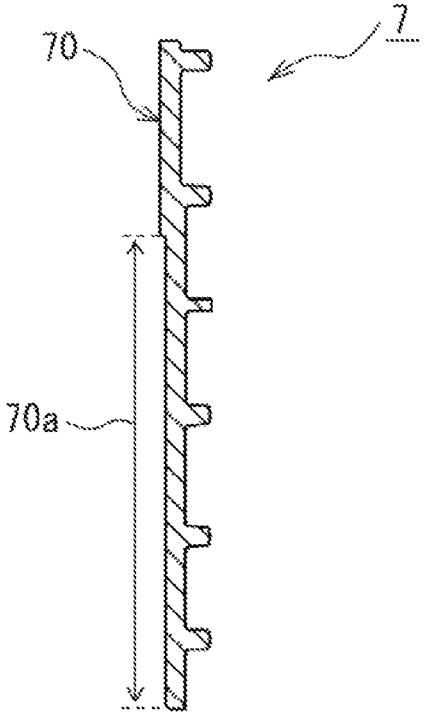
FIG. 11 is a cross-sectional view taken along the line B-B illustrated in FIG. 10.
Figure 12:
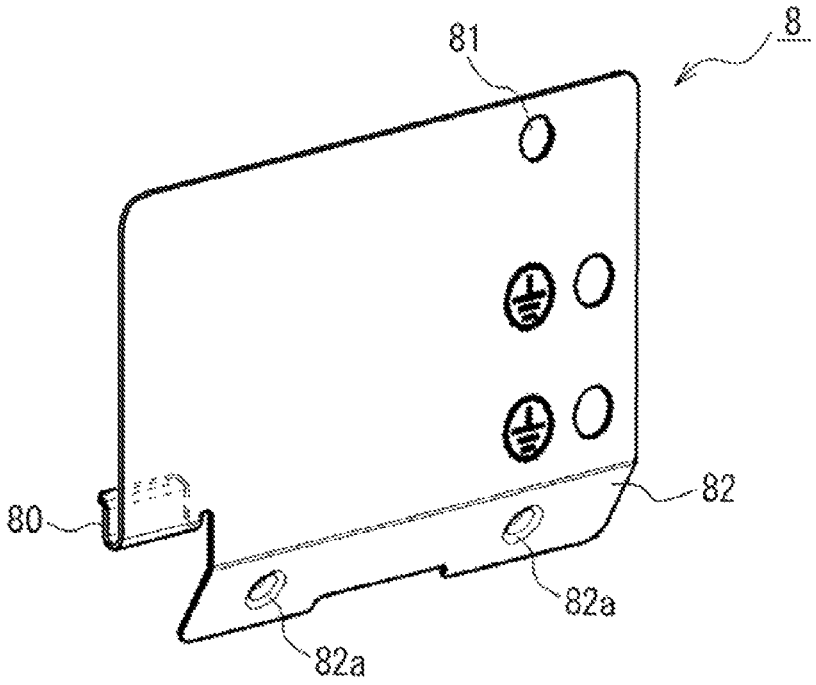
FIG. 12 is a perspective view illustrating an earth grounding plate of the outdoor unit of the air-conditioning apparatus according to the embodiment of the present invention.

A configuration of the power supply unit 5 will be described in detail with reference to FIG. 6 to FIG. 12. FIG. 6 is a perspective view illustrating the power supply unit of the outdoor unit of the air-conditioning apparatus according to the embodiment of the present invention when viewed from the front. FIG. 7 is a perspective view illustrating the power supply unit of the outdoor unit of the air-conditioning apparatus according to the embodiment of the present invention when viewed from the rear. FIG. 8 is an exploded perspective view illustrating a state in which the power supply unit of the air-conditioning apparatus according to the embodiment of the present invention. FIG. 9 is a perspective view illustrating the terminal block of the outdoor unit of the air-conditioning apparatus according to the embodiment of the present invention. FIG. 10 is a perspective view illustrating the terminal block support element of the outdoor unit of the air-conditioning apparatus according to the embodiment of the present invention. FIG. 11 is a cross-sectional view taken along the line B-B illustrated in FIG. 10. FIG. 12 is a perspective view illustrating the earth grounding plate of the outdoor unit of the air-conditioning apparatus according to the embodiment of the present invention.

As illustrated in FIG. 6 to FIG. 8, the power supply unit 5 includes a terminal block 6 disposed in the casing 1, the terminal block support element 7 configured to support the terminal block 6, the earth grounding plate 8 to be sandwiched between the terminal block 6 and the terminal block support element 7. The power supply unit 5 also includes a fixing element 9 serving as a screw element by which the terminal block 6 and the earth grounding plate 8 engaged with the terminal block support element 7 are fastened together to the terminal block support element 7.

In the outdoor unit 100, the electric power necessary for operation is supplied from the outside through the wiring attached to the outdoor unit 100. In the outdoor unit 100, the wiring is used to supply the electric power for operating the indoor unit (not illustrated) of the air-conditioning apparatus and transmit the signal for controlling the indoor unit. The outdoor unit 100 has a configuration in which a plurality of wirings are drawn into the outdoor unit 100 to be connected to the terminal block 6 provided in the outdoor unit 100, thereby transmitting and receiving the electric power and the signal. Note that the terminal block 6 of the outdoor unit 100 is electrically connected to a terminal block of an indoor unit using a VVF cable.

The terminal block 6 is made of a synthetic resin, and as illustrated in FIG. 8 and FIG. 9, the terminal block 6 includes a plurality of internal wiring terminals 6*a* and a plurality of external wiring terminals 6*b*. The terminal block 6 serves as a connection intermediary between the external wiring and the internal wiring when being installed on site. Examples of the external wiring include a connection line with the indoor unit of the air-conditioning apparatus and a power supply line.

As illustrated in FIG. 9, the terminal block 6 is provided with rectangular protrusions 60, 60 extending outwardly from both left and right end faces of the terminal block 6. The protrusion 60 has a cutout 61 formed in the protrusion 60, the cutout having a size enabling an axial portion 90 of the fixing element 9 to pass therethrough. Note that FIG. 9 illustrates a configuration in which the cutout 61 is formed in each of the left and right protrusions 60, but the cutout may be formed only in one of the left and right protrusions 60 through which the axial portion 90 of the fixing element 9 should pass.

The terminal block support element 7 is made of a synthetic resin, and as illustrated in FIG. 4 and FIG. 5, the terminal block support element 7 is attached to an inner surface of the right panel 11 to support the terminal block 6. As illustrated in FIG. 10, the terminal block support element 7 includes a flat-shaped supporting portion 70 to which the terminal block 6 and the earth grounding plate 8 are attached, and flanges 71 protruding toward the right panel 11 from left and right edges of the supporting portion 70. One of the flanges 71 is screw-joined to the corresponding one of the attaching portions 11*b* provided at the opening edge of the opening port 11*a* in the right panel 11. The other flange 71 is provided with the claw portion 71*a*, and the claw portion 71*a* is inserted into a through hole formed in the other attaching portion 11*b* to be attached to the attaching portion 11*b*. That is, the power supply unit 5 is attached in an inclined manner to the inner surface of the right panel 11 by fixing the flanges 71 of the terminal block support element 7 to the attaching portions 11*b* provided at the opening edge of the opening port 11*a* in the right panel 11. Thus, the power supply unit 5 is inclined against the right panel 11, whereby the internal and external connection lines (not illustrated) can be connected to the terminal block 6 with good connection workability. Note that a configuration in which the terminal block support element 7 is attached to the right panel 11 is not limited to the configuration illustrated in FIG. 10, and other configurations may be adopted.

As illustrated in FIG. 10, a rectangular opening port 72 is formed in the supporting portion 70 of the terminal block support element 7. Although not illustrated in detail, the power supply unit 5 is conveyed in a state in which, before the power supply unit 5 is attached to the right panel 11, an upper edge of the opening port 72 is placed on a hook 46 provided on a surface of the electric component unit 4 facing the inner surface of the right panel 11 so that the power supply unit 5 is temporarily fixed to the electric component unit 4.

As illustrated in FIG. 7, FIG. 8, and FIG. 10, a protrusion inserting portion 73 into which one of the protrusions 60 of the terminal block 6 is to be inserted is formed in the terminal block support element 7. Specifically, in the supporting portion 70, a stepped portion 70*b* protruding toward a side on which the terminal block 6 is attached is formed on a surface adjacent to the opening port 72 in the width direction (on a left side in FIG. 8). The protrusion inserting portion 73 communicating with the opening port 72 is formed in the stepped portion 70*b* and extends in the width direction of the supporting portion 70. As illustrated in FIG. 6 to FIG. 8, the protrusion 60 inserted into the protrusion inserting portion 73 is placed on the stepped portion 70*b*, so that the terminal block 6 is positioned on the terminal block support element 7.

Note that the relationship between the protrusion 60 of the terminal block 6 and the protrusion inserting portion 73 of the terminal block support element 7 is not limited to the above-described configuration. Although not illustrated in detail, for example, a configuration may be adopted in which a protrusion or a recess is formed on the supporting portion 70 of the terminal block support element 7, and a recess or a protrusion is formed on the terminal block 6 to be fitted with the protrusion or the recess on the supporting portion 70. Briefly, another configuration may be adopted as long as the supporting portion 70 of the terminal block support element 7 is fitted with the terminal block 6 and the terminal block 6 is positioned on the terminal block support element 7.

As illustrated in FIG. 8, FIG. 10, and FIG. 11, in the supporting portion 70 of the terminal block support element 7, a positioning recessed portion 70*a* is formed below the opening port 72, so that an upper edge and left and right side edges of the earth grounding plate 8 are fitted into the positioning recessed portion 70*a*. It is preferred that the groove depth of the recessed portion 70*a* be substantially the same as the thickness of the earth grounding plate 8 so that the earth grounding plate 8 can be fitted into the recessed portion 70*a*.

As illustrated in FIG. 8 and FIG. 10, one threaded hole 74 into which the axial portion 90 of the fixing element 9 is screwed is formed in the supporting portion 70 of the terminal block support element 7.

Note that, although an explanation was made above on the assumption that the terminal block support element 7 is made of a synthetic resin, the terminal block support element 7 may be formed of a sheet metal. In the outdoor unit 100, the terminal block support element 7 is made of a synthetic resin, thereby improving the flexibility of formation of the opening port 72 and improving the workability when the power supply unit 5 is temporarily fixed to the electric component unit 4. In the outdoor unit 100, the terminal block support element 7 may be formed of a sheet metal and the power supply unit 5 may be fixed to the electric component unit 4 without being temporarily fixed, but since the electric component unit 4 is provided in the upper portion in the casing 1, the size of the protective cover 18 is increased, thereby causing an increase in cost. Accordingly, it is preferred that the terminal block support element 7 be made of a synthetic metal in consideration of the workability and the manufacturing cost. For the above reasons, in the outdoor unit 100 of the air-conditioning apparatus of the present embodiment, the configuration is adopted in which the terminal block support element 7 made of a synthetic resin is combined with the earth grounding plate 8.

As illustrated in FIG. 6 and FIG. 7, the earth grounding plate 8 is made of a sheet metal, and for example, enables the connection line with the indoor unit of the air-conditioning apparatus and the power supply line to be connected to the earth ground. Incidentally, reference numeral 84 denotes a ground screw. As illustrated in FIG. 12, an engaging portion 80 to be engaged with the terminal block support element 7 is formed in the earth grounding plate 8. The engaging portion 80 has a U-shaped clip structure in which a part of the edge of the earth grounding plate 8 is bent back toward the terminal block support element 7. In the example illustrated in FIG. 12, the engaging portion 80 is formed in a U-shape at one end side of a lower edge of the earth grounding plate 8. That is, the earth grounding plate 8 is engaged with the terminal block support element 7 by inserting the edge of the terminal block support element 7 into the U-shape of the engaging portion 80. Note that the engaging portion 80 having a clip structure is not limited to the illustrated embodiment, provided that the earth grounding plate 8 can be engaged with the terminal block support element 7, and for example, the engaging portion 80 may be provided at a part of the upper edge.

The shape of the engaging portion 80 of the earth grounding plate 8 is not limited to the U-shape illustrated in FIG. 12. Although not illustrated in detail, the engaging portion 80 may have a configuration in which for example, a protrusion or a recess is formed on a surface of the earth grounding plate 8, and a recess or a protrusion is formed on the supporting portion 70 of the terminal block support element 7 to be fitted with and engaged with the protrusion or the recess on the earth grounding plate 8. Briefly, another configuration may be adopted providing that the engaging portion 80 enables the earth grounding plate 8 to be engaged with the terminal block support element 7.

As illustrated in FIG. 12, in the earth grounding plate 8, a through hole 81 through which the axial portion 90 of the fixing element 9 passes is formed at a position aligned with the cutout 61 formed in the protrusion 60 of the terminal block 6 and the threaded hole 74 formed in the terminal block support element 7.

The earth grounding plate 8 has a bent surface portion 82 in which the lower end is bent toward the terminal block support element 7. Through holes 82*a* through which axial portions of the screw elements 83 pass are formed in the bent surface portion 82. As illustrated in FIG. 4 and FIG. 5, the earth grounding plate 8 is fixed to the right panel 11 by the screw elements 83 having passed through the through holes 82*a*. Thus, a ground path can be secured by conducting electricity between the earth grounding plate 8 made of a sheet metal and the right panel 11 made of a sheet metal. Accordingly, in the outdoor unit 100 according to the present embodiment, even when electrical leakage occurs from the electric component unit 4, the electric current is passed from the earth grounding plate 8 through the ground line provided in the power supply line, thereby being capable of preventing damage on a human body due to electric shock even when a person touches the outdoor unit.

As illustrated in FIG. 6 and FIG. 8, the fixing element 9 includes one screw element by which the terminal block 6 and the earth grounding plate 8 engaged with the terminal block support element 7 by the engaging portion 80 are fastened together to the terminal block support element 7. The axial portion 90 passes through the cutout 61 of the terminal block 6, and passes through the through hole 81 of the earth grounding plate 8, and then a distal end of the axial portion 90 is screwed into the threaded hole 74 formed in the terminal block support element 7, so that the fixing element 9 is fastened. Note that the terminal block 6 is conventionally fixed by two or more of fixing elements to prevent rotation. However, in the outdoor unit 100 of the air-conditioning apparatus of the present embodiment, the protrusion 60 of the terminal block 6 is positioned by the protrusion inserting portion 73, whereby the rotation can be prevented by one fixing element 9.

In the outdoor unit 100 of the air-conditioning apparatus of the present embodiment, the engaging portion 80 to be engaged with the terminal block support element 7 is formed in the earth grounding plate 8, and the fixing element 9 is provided to fasten the terminal block 6 and the earth grounding plate 8 engaged with the terminal block support element 7 together to the terminal block support element 7. Therefore, in the outdoor unit 100, since during the assembling work for attaching the terminal block 6 and the earth grounding plate 8 to the terminal block support element 7, the earth grounding plate 8 is engaged with and temporarily fixed to the terminal block support element 7 by the engaging portion 80 so that the earth grounding plate 8 is stably held, the terminal block 6 and the earth grounding plate 8 can be fastened together to the terminal block support element 7 by a common fixing element 9, whereby man hours required for the assembling work can be reduced and the workability can be improved.

Furthermore, in the outdoor unit 100, since the terminal block 6 and the earth grounding plate 8 are fastened together to the terminal block support element 7 by the common fixing element 9, the number of elements can be reduced, and in the terminal block 6, the terminal block support element 7 and the earth grounding plate 8, a plurality of through holes do not have to be formed through which the axial portion 90 of the fixing element 9 passes. Therefore, in the outdoor unit 100, the manufacturing cost can be reduced.

The outdoor unit 100 of the air-conditioning apparatus of the present embodiment has a configuration in which the earth grounding plate 8 is engaged with the terminal block support element 7 by inserting the edge of the terminal block support element 7 into the U-shape of the engaging portion 80 formed by bending back a part of the edge of the earth grounding plate 8. Accordingly, the earth grounding plate 8 having a very simple structure is easily formed, and the earth grounding plate 8 is securely engaged with and temporarily fixed to the terminal block support element 7.

In the outdoor unit 100 of the air-conditioning apparatus of the present embodiment, the terminal block 6 is provided with the protrusions 60 protruding toward the terminal block support element 7, and the protrusion inserting portion 73 into which the protrusion 60 is to be inserted is formed in the terminal block support element 7. Therefore, the terminal block 6 is temporarily fixed to the terminal block support element 7 so that the terminal block 6 is stably held, whereby the terminal block 6 and the earth grounding plate 8 can be fastened together to the terminal block support element 7, thereby improving the workability.

In the outdoor unit 100 of the air-conditioning apparatus of the present embodiment, since the earth grounding plate 8 is fixed to the casing 1, a ground path can be secured conducting electricity between the earth grounding plate 8 and the casing 1. Accordingly, in the outdoor unit 100, even when electrical leakage occurs from the electric component unit 4, the electric current is passed from the earth grounding plate 8 through the ground line provided in the power supply line, thereby capable of preventing damage on a human body due to electric shock even when a person touches the outdoor unit.

REFERENCE SIGNS LIST

1 Casing 2 Fan compartment 3 Machine compartment 4 Electric component unit 5 Power supply unit 6 Terminal block 6*a* Internal wiring terminal 6*b* External wiring terminal 7 Terminal block support element 8 Earth grounding plate 9 Fixing element 10 Front-and-side panel 11 Right panel 11*a* Opening 11*b* Attaching portion 12 Bottom panel 13 Top panel 14 Rear panel 15 Leg portion 16 Fan guard 17 Separator 18 Protective cover 20 Heat exchanger 21 Propeller fan 22 Motor 23 Motor mount 30 Compressor 31 Refrigerant pipe 40 Control circuit substrate 41 Substrate fixing frame 42 Substrate protective sheet metal 43 Heat sink 44 Insulating protective element 45 Heat sink fixing sheet metal 46 Hook 60 Protrusion 61 Cutout 70 Supporting portion 70*a* Recessed portion 70*b* Stepped portion 71 Flange 71*a* Claw portion 72 Opening 73 Protrusion inserting portion 74 Threaded hole 80 Engaging portion 81 Through hole 82 Bent surface portion 82*a* Through hole 83 Screw element 84 Ground screw 90 Axial portion 100 Outdoor unit

The invention claimed is:

1. An outdoor unit of an air-conditioning apparatus, comprising:

a casing that forms an outer shell;

a terminal block disposed in the casing;

a terminal block support element configured to support the terminal block; and an earth grounding plate sandwiched between the terminal block and the terminal block support element, wherein:

the earth grounding plate has an engaging portion which has a U-shape formed by bending back a part of an edge of the earth grounding plate, the earth grounding plate is engaged with the terminal block support element by inserting the edge of the terminal block support element into the U-shape of the engaging portion, and the terminal block and the earth grounding plate engaged with the terminal block support element by the engaging portion are fastened together to the terminal block support element by a fixing element.

2. The outdoor unit of an air-conditioning apparatus of claim 1, wherein a protrusion protruding toward the terminal block support element is provided in the terminal block, and a protrusion inserting portion into which the protrusion is to be inserted is formed in the terminal block support element.

3. The outdoor unit of an air-conditioning apparatus of claim 1, wherein the earth grounding plate is fixed to the casing by a screw element.

* * * * *